US005214348A

United States Patent [19]

Nakamura et al.

[11] Patent Number: 5,214,348

[45] Date of Patent: May 25, 1993

[54] COLOR CRT WITH INSULATING STUD PINS FOR SHADOW MASK SUPPORT

[75] Inventors: Koji Nakamura, Nagaokakyo; Keitaro Tsukui; Junko Itoh, both of Amagasaki, all of Japan

[73] Assignee: Mitsubishi Denki Kabushiki Kaisha, Tokyo, Japan

[21] Appl. No.: 788,949

[22] Filed: Nov. 7, 1991

[30] Foreign Application Priority Data

Nov. 19, 1990 [JP] Japan ..... 2-313348

[51] Int. Cl.[5] ..... H01J 29/07; H01J 29/86

[52] U.S. Cl. ..... 313/406; 313/477 R; 220/2.3 A

[58] Field of Search ..... 313/406, 477 R; 220/2.3 A

[56] References Cited

U.S. PATENT DOCUMENTS

| | | | |
|---|---|---|---|
| 2,727,172 | 12/1955 | Mark et al. | 313/406 X |
| 2,855,529 | 10/1958 | Morrell | 220/2.3 A |
| 3,404,769 | 10/1968 | Bishop | 220/2.3 A |
| 4,638,213 | 1/1987 | Deal et al. | 313/477 R X |

FOREIGN PATENT DOCUMENTS

| | | |
|---|---|---|
| 2939624 | 4/1981 | Fed. Rep. of Germany . |
| 3033978 | 3/1985 | Fed. Rep. of Germany . |
| 58-7222 | 4/1976 | Japan . |
| 59-51702 | 4/1980 | Japan . |
| 106349 | 8/1981 | Japan . |
| 2-47550 | 6/1983 | Japan . |
| 61-203536 | 9/1986 | Japan . |
| 2-86033 | 3/1990 | Japan . |
| 586797 | 4/1947 | United Kingdom . |

OTHER PUBLICATIONS

Patents Abstracts of Japan (in Re Kokai No. 53-145558), E-90, vol. 3, No. 17, Feb. 1979.

*Primary Examiner*—Palmer C. DeMeo

[57] ABSTRACT

The applications of the CRT proposed by the present invention include televisions and computer terminals, and the object of the present invention is to increase electrical security of the CRT. The CRT has a metal part 8 forming a vacuum glass container in order to reduce the weight of the CRT. A stud pin 12 made of an insulating material is on the inner surface of the metal part and fixes the shadow mask. The metal part 8 is joined between an edge of the panel screen 2*a* and an edge of the funnel 4, and forms a part of the vacuum container where the highest stress is applied. The stud pin 12 is fixed to the inner surface of the metal part 8 and fixes the shadow mask 10 by sealing to a plate spring 13 welded to the edge of the shadow mask 10. Since the stud pin 12 is insulating, it electrically separates the metal part 8 from the high voltage shadow mask 10. The stud pin 12 has a constriction or a multistage fin, and around the stud pin shielding material 16 made of a metal mesh or a metal plate is placed.

5 Claims, 7 Drawing Sheets

COLOR CRT WITH INSULATING STUD PINS FOR SHADOW MASK SUPPORT

BACKGROUND OF THE INVENTION

1. Field of the Invention:

This invention relates to a color CRT used as a television set or a computer terminal.

2. Description of the Related Art:

Cathode-ray tubes (CRTs, hereafter) are used for television sets or various kinds of computer terminals. In order to form an image on the screen, a CRT has an electron gun in an envelope maintaining a high vacuum of $10^{-8}$ Torr. The electron gun emits an electron beam through slits in a shadow mask to an RGB fluorescent screen on a front glass, the electrons hit the screen which emits designated colors, and forms an image on the screen. When considering the avoidance of implosions, a sphere is a favorable shape for CRTs because they are made of glass which reduces the cost of production and enables easier production. As a screen, on the other hand; flat is the most favorable shape. Therefore, one of the most important points in designing CRTs is how to coordinate the two conflicting factors.

In the following, Conventional color CRTs are explained with figures.

FIG. 5 is a side view of a conventional color CRT, a part of which is cut out to show its inside. In this figure, the CRT 1 consists of a panel 2, a funnel 4 adjacent to the panel 2, and a neck 5 which is adjacent to the funnel 4 and has an electron gun inside (not shown in the figure). The panel 2 includes a panel screen 2*a* whose inner surface is coated by a fluorescent screen 3, and a panel skirt 2*b*. The panel skirt 2*b* is sealed with the funnel 4 by frit glass, which is a kind of solder glass having thermal plasticity, at a sealing part 6. Inside the CRT 1, a shadow mask 10 is positioned facing the fluorescent screen 3. In order to avoid deformation of the shadow mask 10, it is fixed to a frame 11 by a stud pin 9 attached to the panel skirt 2*b*, through a plate spring 13 that is fixed to the frame 11. The CRT as a whole is attached to a device body (not shown in the figure) by fixtures 7 located on the four corners of the panel skirt 2*b*.

FIG. 6 is a front view of the CRT 1 viewing from the panel 2. Here, X, Y, and Z axes are defined as shown in the figure and the diagonal lines of the fluorescent screen 3 is defined as P axes. As shown in the figure, each of the panel and the fluorescent screen forms a shape quite similar to a rectangle. The ratio of the length of the longer side of the fluorescent screen and the length of the shorter side of the fluorescent screen is usually approximately 4:3.

Since the inside of the CRT 1 is kept at a high vacuum, the direction of deformation is inward. With respect to this type of deformation, we have to separately consider the strength of the two sides of the glass, the outside (against atmospheric pressure) and the inside (against the vacuum). The strength of the glass against the vacuum depends on its compression strength and is negligible, since it is far greater than the tensile strength of the glass. Therefore, only the strength of the external surface of the glass is considered in the following explanations.

FIGS. 7 through 9 show the stress distribution of a CRT. FIG. 7 shows the stress distribution along the Y axis of FIG. 6. In this figure, a solid line SA indicates the cross section of the CRT 1 along the Y axis, and a dashed line 21 shows the stress distribution at the surface of the CRT 1. The figure shows that the critical area covers from an edge of the screen of panel 2 to the sealing part 6, when the inside of the CRT 1 is a vacuum.

FIGS. 8 and 9 show the stress distribution along the X axis cross section and the P axis cross section respectively. In the figures, the solid lines LA and DA show the cross section of the CRT 1 along the X axis and the P axis respectively. The dashed lines 22 and 23 show the stress distribution at each cross section based on the surface of the CRT 1. These figures show that the critical point of tension of CRT as a glass vacuum container is around the area from an edge of the panel screen 2*a*, through the panel skirt 2*b*, to the funnel 4. Therefore, these parts should be reinforced by, for example, increasing the thickness of the glass.

By increasing the thickness of the glass, however, the weight of the CRTs also increases, which is undesirable. In order to eliminate the shortcoming, methods such as Japanese Patent Laid Open No. Hei 2-86033 are proposed.

FIG. 10 shows a side view of a conventional CRT, a part of which is cut out to show its inside. This number attached to each part is identical to that of FIG. 5 and explanation is omitted where appropriate. In the CRT, a part of the envelope (the area from the panel skirt 2*b* to the funnel 4) is made of metal (metal part 8). On the inner surface of the metal part 8, there is a stud pin 9 which is inserted into a positioning hole of a plate spring 13 which is fixed to the frame 11 of a shadow mask 10. In CRTs having this type of configuration, the metal part 8 is more than ten times as strong as glass, and the weight is significantly reduced even if we account for the difference in the specific gravities of the two materials.

However, because the stud pin 9 is made of metal, the electric potential of the metal part 8 and the fluorescent screen 3 becomes equal to that of the shadow mask 10, and in practice a high voltage of, for example, 28 kV is applied. This could cause a dangerous electrical shock when producing or repairing image receiving tubes having CRTs. Therefore, the metal part 8 should be covered by insulation film, but the area of the metal part 8 is so large that uniform covering with the insulation film is quite difficult.

Another method for avoiding electrical shock is to make the fluorescent screen 3, the metal part 8 and the shadow mask 10 be at an equal electric potential, while making the metal part 7 be at an earth potential and the cathod of the electron gun be at a potential of −28 kV. This method, however, is not realistic because the circuit would have to be totally redesigned.

SUMMARY OF THE INVENTION

It is therefore an object of the present invention to provide a color CRT, using metal as a part of an envelope, that reduces the overall weight and has high security against electrical shock.

There are related inventions including Japanese Utility Model Publication No. Hei 2-47550, Japanese Patent Laid Open No. Sho 56-106349, Japanese Patent Publication No. Sho 59-51702, Japanese Patent Laid Open No. Sho 61-203536, and Japanese Patent Publication No. Sho 58-7222, but all of them use glass for the CRTs and both the objective and effectiveness are different from the present invention.

The color CRT proposed by the present invention partially consists of metal forming a part of a vacuum glass container, and the inner surface of the metal part has a stud pin made of an insulating material that fixes a shadow mask.

The metal forms a part of the CRT where the highest stress is applied to the vacuum glass container: namely the area from the edge of the panel screen, through the panel skirt, to the funnel. The insulating stud pin is attached to the inner surface of the metal part, and fixes the shadow mask by being inserted into a hole of a plate spring which is welded to the edge of the shadow mask. Because the stud pin is made of an insulating material, the metal part is isolated from the shadow mask having a high electrical potential, which avoids electrical shock.

Moreover, by adding a constriction or a multistage fin to the stud pin, the creeping distance increases, which results in safer electrical separation between the metal part and the shadow mask.

Furthermore, by placing metal mesh and shielding material such as metal plate, turbulence of electrical field around the neighborhood or changes in surface resistance caused by splash of getters are avoided.

BRIEF DESCRIPTION OF THE DRAWINGS

The accompanying drawings and their descriptions will facilitate an understanding of the invention. In this drawing, by way of illustration and not of limitation.

DESCRIPTION OF THE PREFERRED EMBODIMENTS

A preferred embodiment in accordance with the present invention will now be described in detail.

Figure 1:
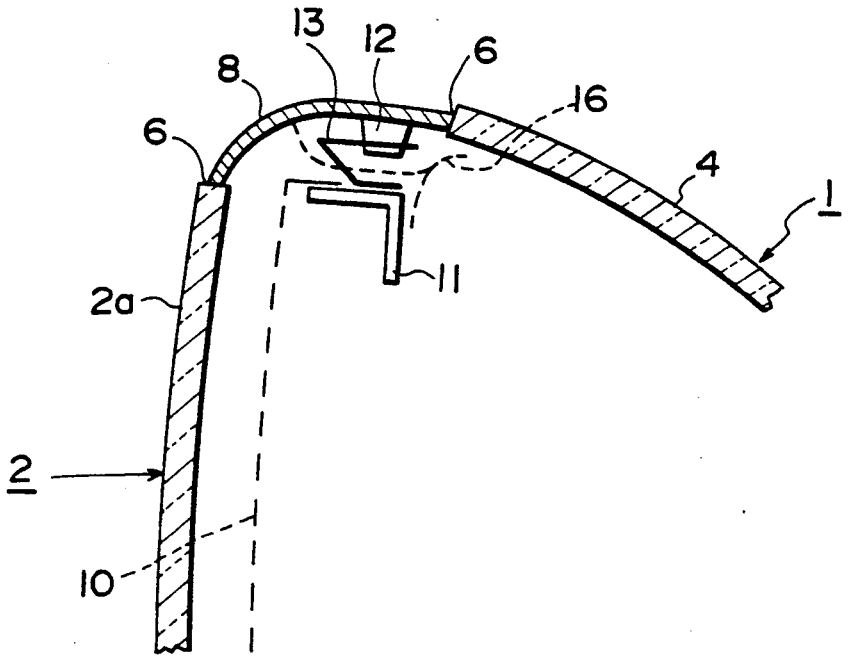
FIG. 1 is a cross-sectional view of a part of a preferred embodiment in accordance with the present invention.
Figure 5:
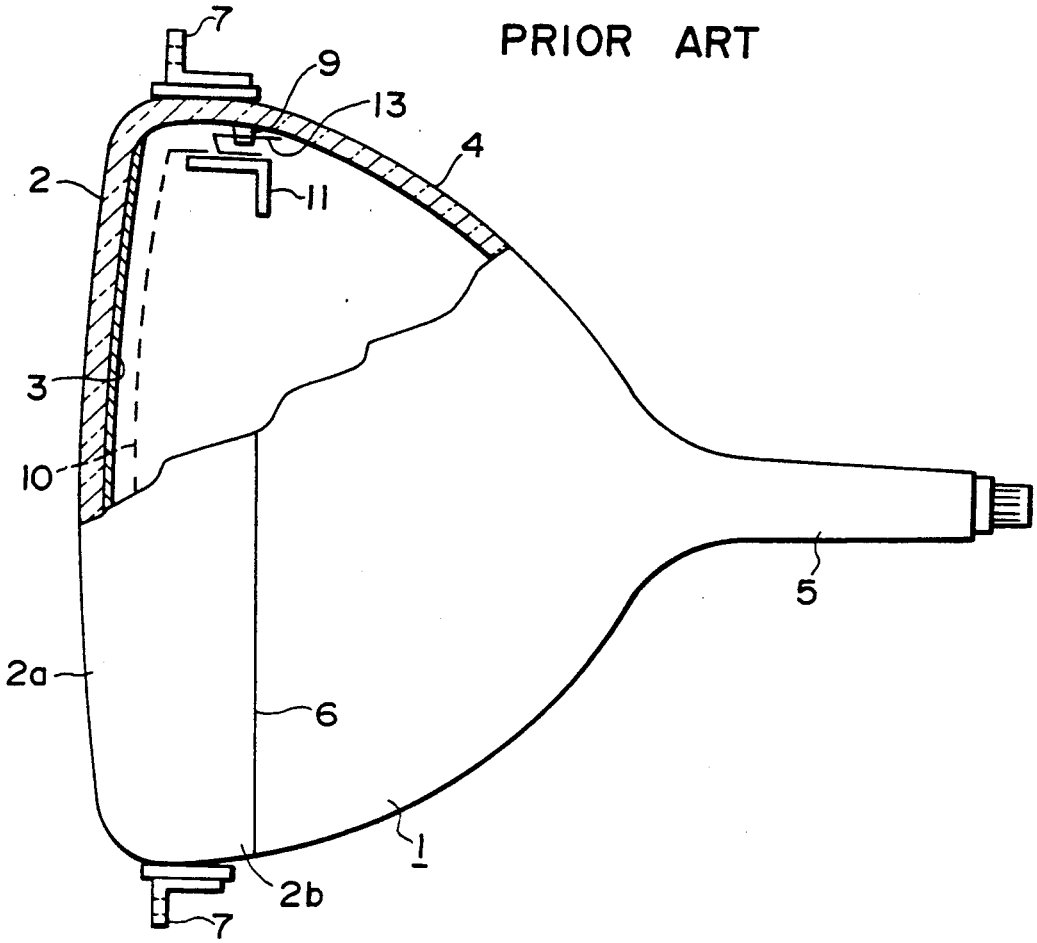
FIG. 5 PRIOR ART
FIG. 5 shows a side view of a conventional color CRT, a part of which is cut out.
Figure 6:
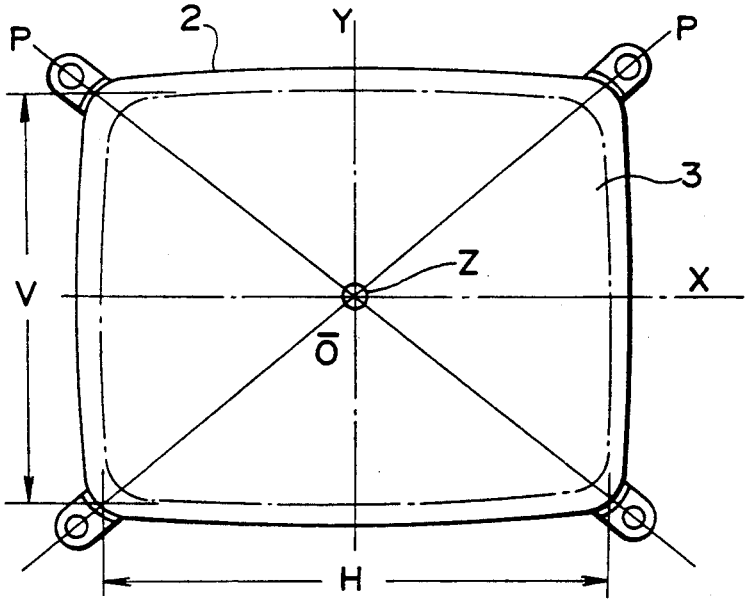
FIG. 6 PRIOR ART
FIG. 6 shows a front view of a conventional color CRT.
Figure 7:
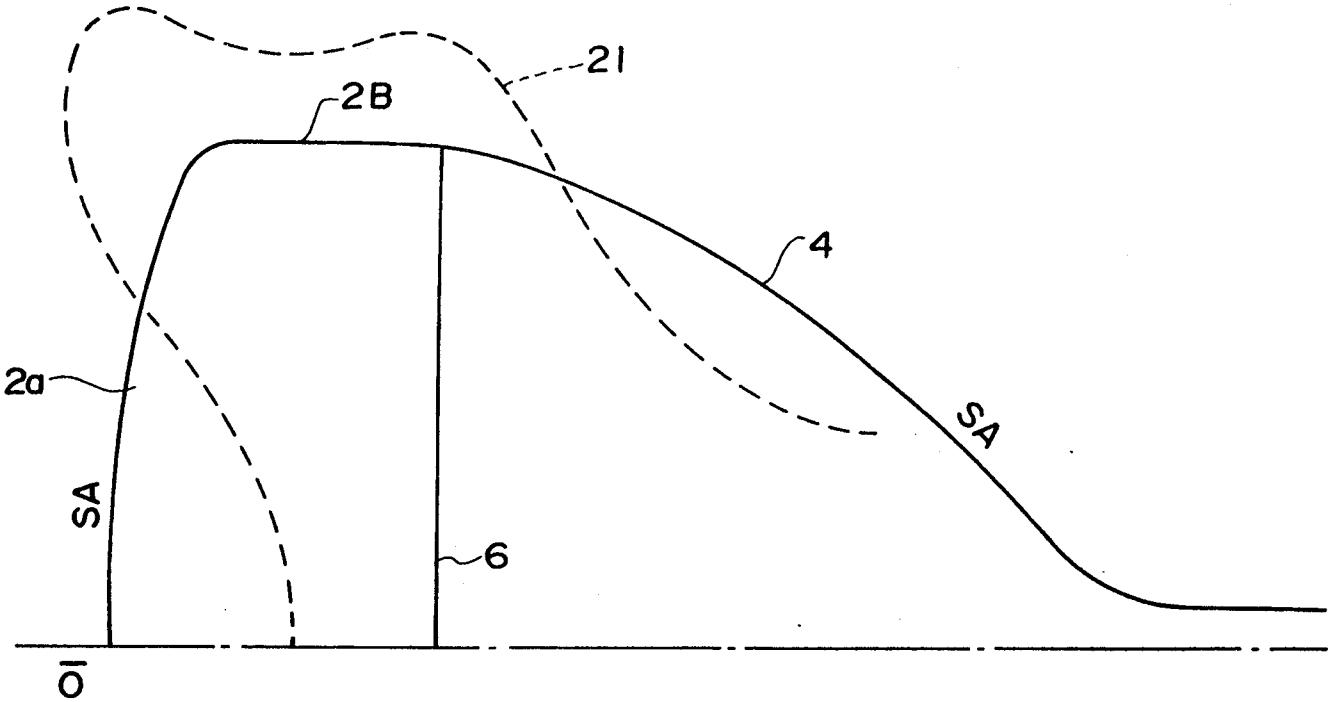
FIG. 7 shows stress distribution along the Y axis cross section of the conventional color CRT.
Figure 8:
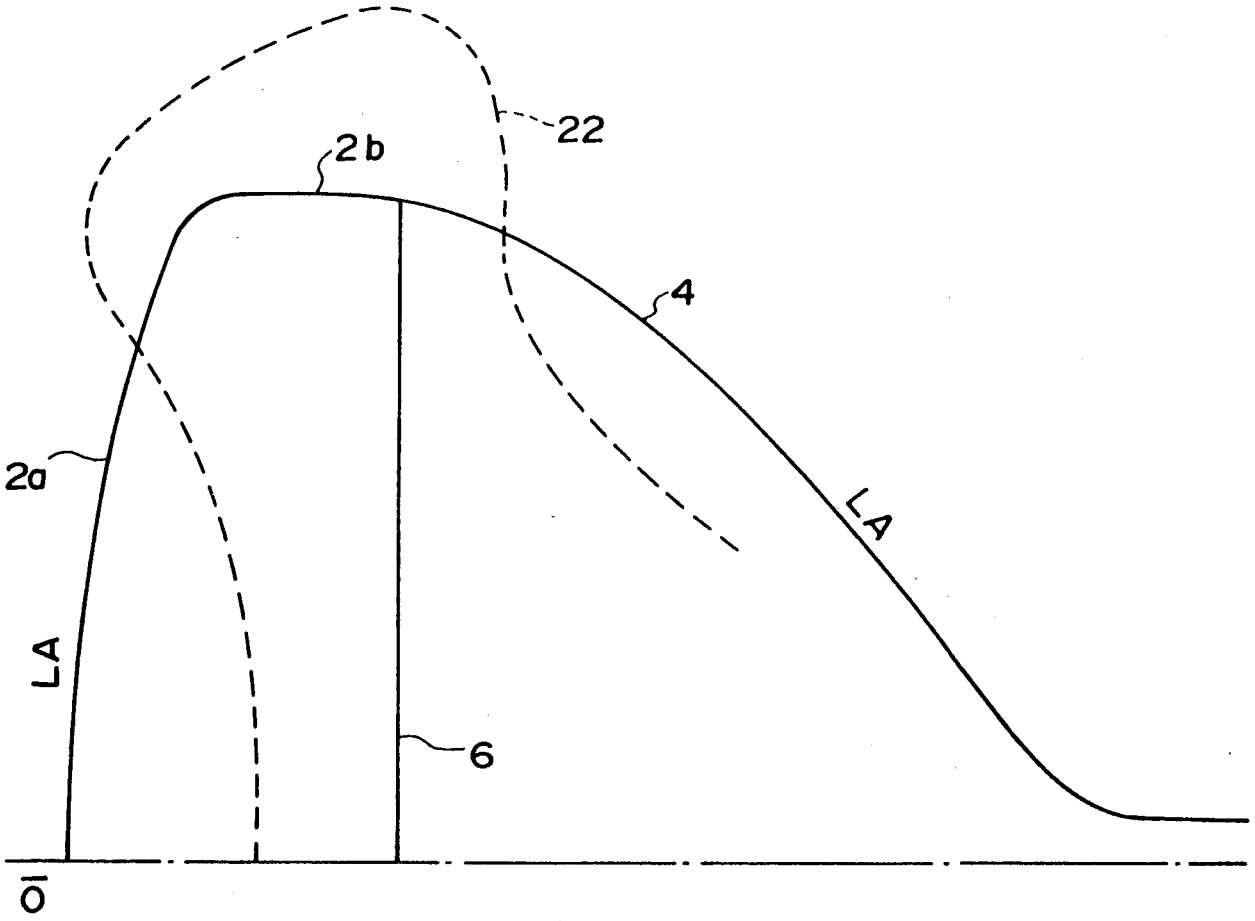
FIG. 8 shows stress distribution along the X axis cross section of the conventional color CRT.
Figure 9:
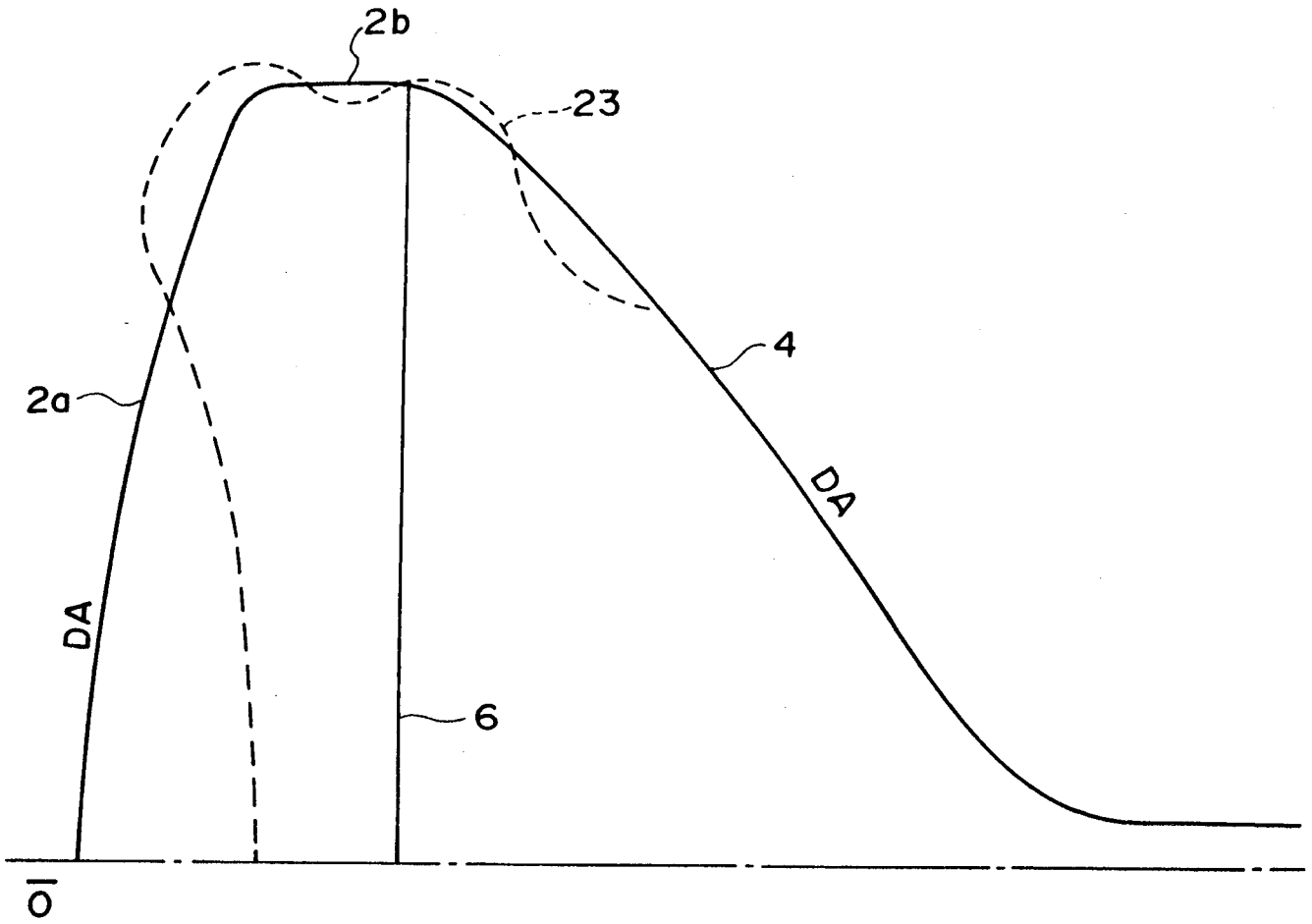
FIG. 9 shows stress distribution along the P axis cross section of the conventional color CRT.
Figure 10:
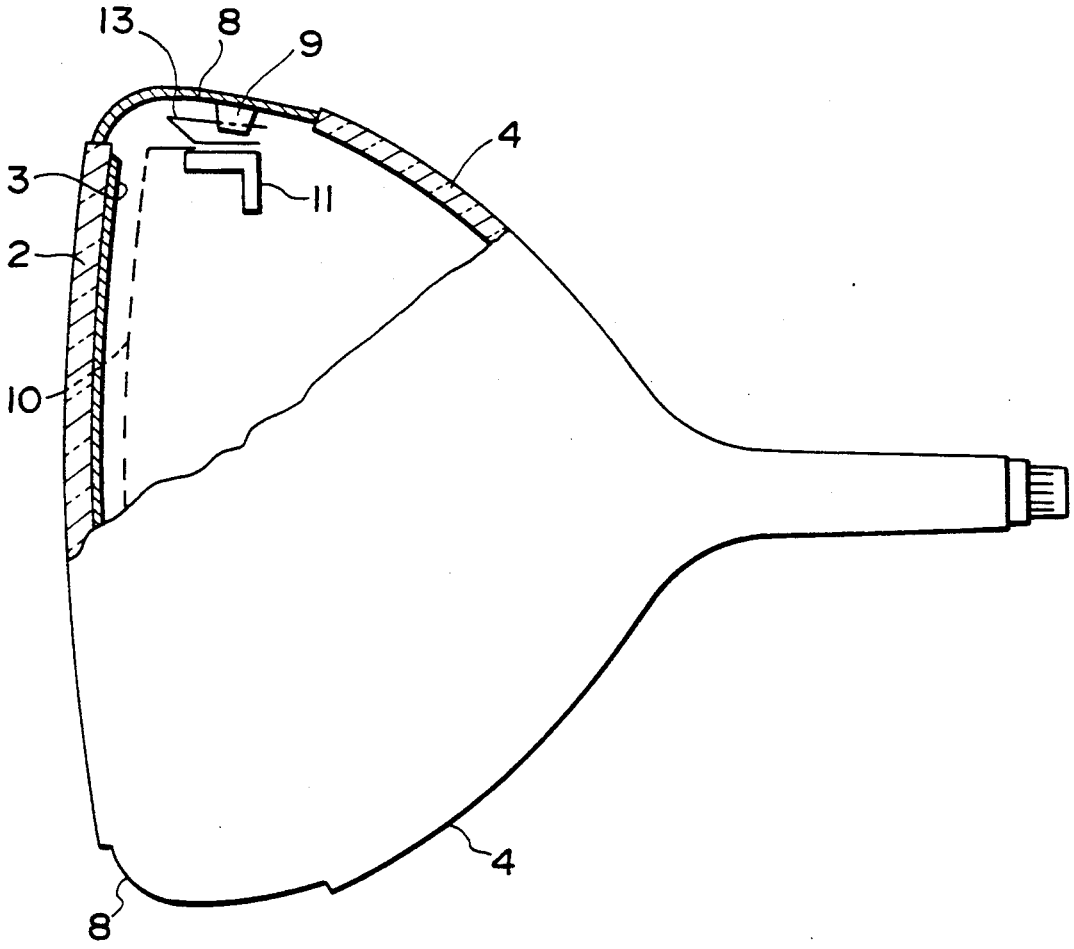
FIG. 10 PRIOR ART
FIG. 10 shows a side view of another embodiment of a conventional color CRT, a part of which is cut out.

FIG. 1 is a cross-sectional view of a part of a preferred embodiment in accordance with the present invention. The number attached to each part is identical to that of FIG. 5 and explanation is omitted where appropriate. At a designated point between an edge of the panel screen 2*a* and an edge of the funnel 4 of the CRT 1, a metal part 8 is joined by solder glass such as frit glass. The metal part 8 extends from an edge of the panel screen 2*a* to an edge of the funnel 4 where the highest stress is applied to the vacuum glass container. The panel screen 2*a* and the funnel 4 is made of conventional materials such as "H5702" or "LOF03" standardized by the Electronic Industries Association of Japan. Material having a coefficient of thermal expansion almost equal to that of the panel screen 2*a* and the funnel 4, such as 13Cr-Fe, is used for the metal part 8.

The insulating stud pin 12 is attached to the inner surface of the metal part 8, and fixes the shadow mask by being inserted into a hole of a plate spring 13 which is welded to the edge of the shadow mask. The stud pin 12 can be made of ceramics and is fixed to the metal part 8 by solder glass.

Figure 2:
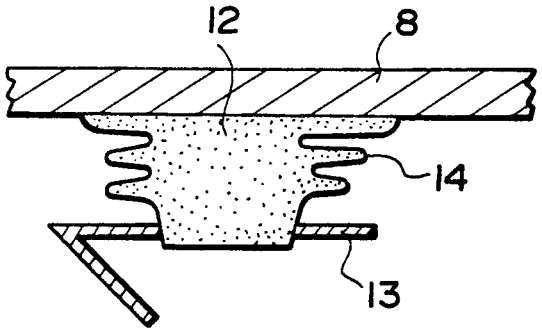
FIG. 2 is an enlarged cross-sectional view of an embodiment of a stud pin that is attached to the inner surface of a metal part of a color CRT in accordance with the present invention.
Figure 3:
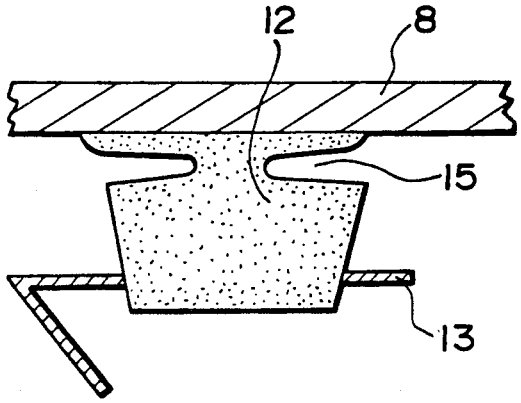
FIG. 3 is an enlarged cross-sectional view of another embodiment of a stud pin that is attached to the inner surface of a metal part of a color CRT in accordance with the present invention.

FIG. 2 shows an embodiment of the stud pin 12. A multistage fin 14 is included on the surface of the stud pin in order to increase the creeping distance. FIG. 3 is another embodiment of the stud pin. A constriction 15 is included on the surface of the stud pin in order to increase the creeping distance.

Figure 4:
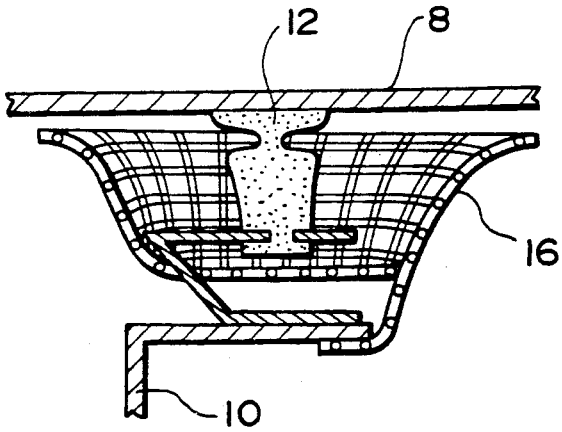
FIG. 4 shows an enlarged cross-sectional view of configuration of a shielding material placed around the stud pin that is attached to the inner surface of a metal part of a color CRT in accordance with the present invention.

FIG. 4 shows the configuration of a shielding material 16 placed around the stud pin 12. The shielding material 16 made of metal mesh or metal plate is welded to an edge of the shadow mask 10 and surrounds the stud pin 12.

With a CRT 1 having above configuration, when a high voltage is applied to the fluorescent screen 3 or the shadow mask 10, the metal part 8 is electrically separated from the high voltage shadow mask and is maintained at the earth voltage, because the stud pin is insulating. Thus, electrical shock is avoided.

Moreover, as shown in FIGS. 2 and 3, by adding a multistage fin 14 or a constriction 15 to the stud pin, the creeping distance increases, which results in safer electrical separation between the metal part 8 and the shadow mask 10.

Furthermore, as shown in FIG. 4, by placing the shielding material such as metal mesh or metal plate, turbulence of the electrical field in the vicinity of the stud pin is controlled and the effect of the turbulence on the trace of the electron beam emitted from the electron gun to the fluorescent screen 3 is reduced.

Furthermore, the shielding material avoids changes in surface resistance caused by getter splashes.

Although a shadow mask type color CRT is used in this embodiment, the method of the present invention is applicable to a flat type color CRT using a vacuum container in which an image is formed by emitting an electron beam towards a high voltage fluorescent screen. In this case, the voltage must be greater than 5 kV.

This method is also applicable to a black and white CRT or a mono-chrome CRT.

What is claimed is:

1. A color CRT comprising:

(a) a panel screen made of glass coated with an RGB fluorescent screen;

(b) a neck made of glass including an electron gun;

(c) a funnel made of glass adjacent to the neck;

(d) a metal part that is jointed between an edge of the panel screen and an edge of the funnel, and combined with the panel screen, the neck, and the funnel, to form a vacuum container;

(e) a shadow mask placed inside the vacuum container, adjacent to the panel screen; and (f) stud means made of an insulating material placed on the inner surface of the metal part, for holding the shadow mask and electrically separating the shadow mask from the metal part;

wherein the stud means includes a plurality of stud pins made of ceramic;

wherein the plurality of stud pins are fixed to the metal part with solder glass;

wherein each of the plurality of stud pins has a constriction which increases creeping distance.

2. The color CRT of claim 1, wherein the constriction for each of the plurality of stud pins which increases the creeping distances is a multistage fin.

3. The color CRT of claim 1, further comprising shielding material placed around each of the plurality of stud pins, which reduces turbulence of the electrical field in the vicinity of each of the plurality of stud pins or changes in surface resistance caused by getter splashes.

4. The color CRT of claim 3, wherein the shielding material includes a metal mesh.

5. The color CRT of claim 3, wherein the shielding material includes a metal plate.

* * * * *